US006250523B1

(12) United States Patent
Louw

(10) Patent No.: US 6,250,523 B1
(45) Date of Patent: Jun. 26, 2001

(54) MULTIPLE GARMENT HANGER

(76) Inventor: Henry John Louw, Dreyersdal Road, Bergvliet 7800 (ZA)

( * ) Notice: Subject to any disclaimer, the term of this patent is extended or adjusted under 35 U.S.C. 154(b) by 0 days.

(21) Appl. No.: 09/469,076

(22) Filed: Dec. 21, 1999

(51) Int. Cl.[7] ..... A47G 25/30
(52) U.S. Cl. ..... 223/96; 223/91
(58) Field of Search ..... 223/90, 91, 93, 223/85, 96; D6/326

(56) References Cited

U.S. PATENT DOCUMENTS

| | | | | |
|---|---|---|---|---|
| D. 146,998 | * | 6/1947 | Townsend et al. | 223/96 |
| D. 260,342 | | 8/1981 | Eiley et al. . | |
| D. 305,834 | | 2/1990 | DeVito . | |
| D. 305,835 | | 2/1990 | DeVito . | |
| D. 327,581 | * | 7/1992 | Fildan | D6/326 |
| 2,318,770 | * | 5/1943 | Freeman | 223/93 |
| 2,469,481 | | 5/1949 | Snyder . | |
| 2,797,030 | | 6/1957 | Millhuff . | |
| 4,148,421 | | 4/1979 | Levitt . | |
| 4,623,079 | | 11/1986 | Tendrup . | |
| 5,005,742 | | 4/1991 | Smith . | |
| 5,411,189 | | 5/1995 | Gouldson . | |
| 5,632,423 | | 5/1997 | Louw . | |

* cited by examiner

*Primary Examiner*—Bibhu Mohanty
(74) *Attorney, Agent, or Firm*—Ostrolenk, Faber, Gerb & Soffen, LLP

(57) ABSTRACT

A multiple garment hanger includes a hook extending in a first direction from an elongated bar. A first and second garment clip arrangement are disposed at respective distal ends of the elongated bar. Each garment clip arrangement includes a plurality of garment clips. The garments clips are tilted with respect to the first direction and with respect to the elongated bar so that a first garment clip overlaps at least a portion of a second garment clip disposed immediately below the first garment clip.

26 Claims, 2 Drawing Sheets

MULTIPLE GARMENT HANGER

BACKGROUND OF THE INVENTION

1. Field of the Invention

Figure 1:
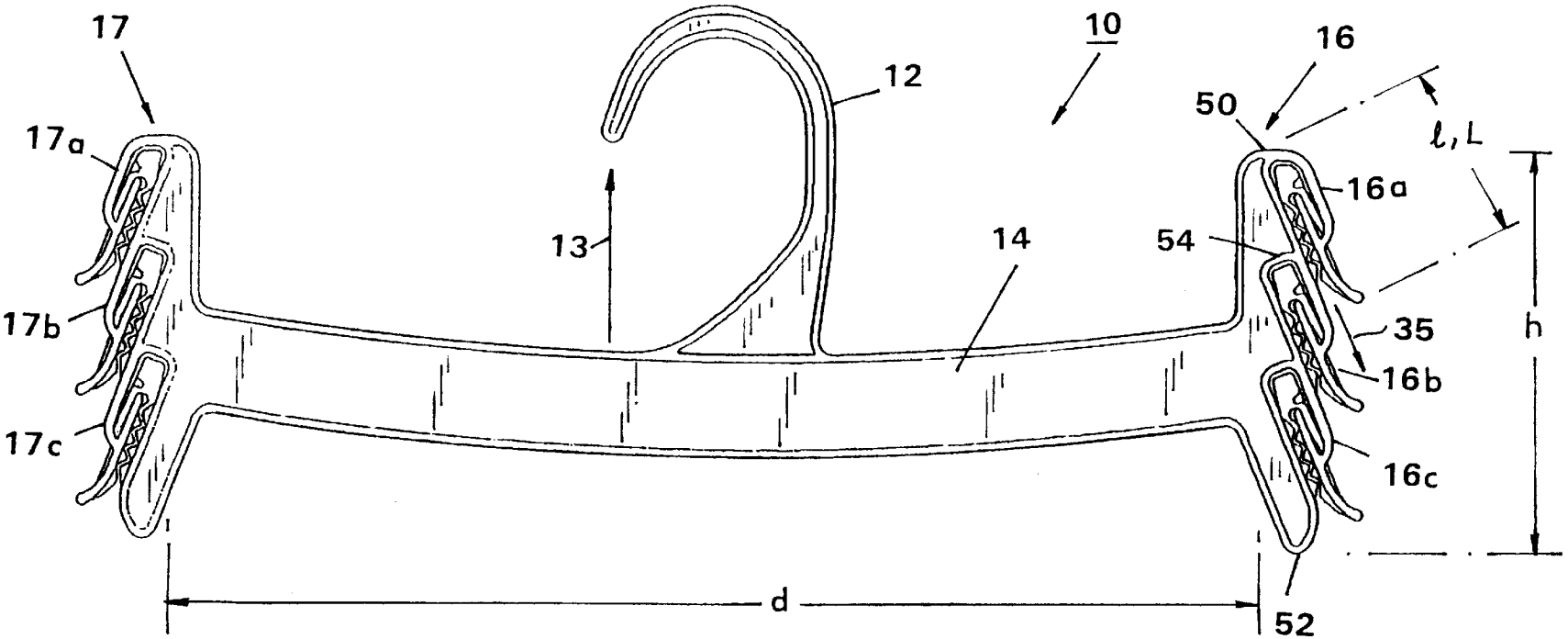

The present invention relates to a hanger and, more particularly, to a multiple garment hanger that is capable of displaying a plurality of garments.

2. Description of the Related Art

The sale of garments, and in particular panties, is frequently promoted by discounted packs of two or more panties. This results in many panties being displayed on a single hanger. Conventional hangers for displaying multiple garments, like that shown in U.S. Pat. No. Des. 305,834, for example, have a hook extending from an elongated piece; the elongated piece having first and second hanging clip arrangements disposed at distal ends thereon. To display multiple garments, additional garment clips are simply disposed above one another within the hanging clip arrangements. The placement of these additional garment clips is problematic in that such placement requires additional vertical space for each additional garment clip.

Other conventional techniques for displaying multiple garments, like U.S. Pat. No. Des. 305,835, also have first and second hanging clip arrangements each disposed at distal ends of an elongated bar. In this prior art arrangement, the distance between a clip in the first hanging clip arrangement and a corresponding clip in the second hanging clip arrangement is different for each set of clips; i.e., the distance between a first lower pair of clips (one on each of the first and second hanging clip arrangements) is smaller than the distance between a second higher pair of clips. Though the vertical space required for this hanger can be less than the previously discussed prior art hanger, this arrangement does not yield an acceptable and pleasing display for customers. This is because the garments in Des. 305,835 are hung with varied display widths due to the varied distances between corresponding clips in the first and second and hanging clip arrangements and so the garments do not have a uniform vertical outer display line.

Thus, there exists a need in the art for a hanger which can display multiple garments that requires less space than prior art hangers and which can maintain a uniform vertical outer display line.

SUMMARY OF THE INVENTION

It has been found that the above disadvantages are overcome in a hanger that includes an elongated bar and at least one garment clip arrangement disposed on the elongated bar. The garment clip arrangement has at least a first and a second garment clip. The first garment clip is disposed above the second garment clip and overlaps at least a portion of the second garment clip.

Preferably, the hanger further includes a hook extending from the elongated bar in a first direction. The garment clips are disposed obliquely with respect to the first direction.

In a preferred embodiment, a hanger includes an elongated bar and at least one garment clip arrangement disposed on the elongated bar. The at least one garment clip arrangement has at least a first and second garment clip. Each garment clip has a top and a bottom. The garment clips are arranged so that the distance between a top of a first garment clip and a top of a second garment clip disposed immediately below the first garment clip, is less than the distance between the top of the first garment clip and a bottom of the first garment clip.

Preferably, the first clip is disposed over the second clip and the first clip further overlaps at least a portion of the second clip.

Preferably, a hook extends from the elongated bar in a first direction and the garment clips are disposed obliquely with respect to the first direction.

In another preferred embodiment, a hanger includes an elongated bar, a hook extending from said elongated bar in a first direction and at least a first and a second garment clip arrangement disposed on the elongated bar. Each garment clip arrangement has at least a first and a second garment clip. Each garment clip is disposed obliquely with respect to the first direction.

In another preferred embodiment, a hanger includes an elongated bar extending in a generally horizontal direction and at least one garment clip arrangement disposed on the elongated bar. The garment clip arrangement has at least a first and a second garment clip. The garment clips are disposed angularly with respect to the elongated bar.

Preferably, the first garment clip is disposed above the second garment clip and overlaps at least a portion of the second garment clip.

In another preferred embodiment, a hanger for hanging at least one garment above a floor includes an elongated bar and at least one garment clip arrangement disposed on the elongated bar. The garment clip arrangement has at least a first and a second garment clip. The garment clips are disposed angularly with respect to a plane defined by the floor.

These aspects and advantages of the present invention, as well as others, will become apparent from the following description of the preferred embodiments which refers to the accompanying drawings.

BRIEF DESCRIPTION OF THE DRAWING(S)

For the purpose of illustrating the invention, there is shown in the drawings a form which is presently preferred, it being understood, however, that the invention is not limited to the precise arrangements and instrumentalities shown.

Figure 2:
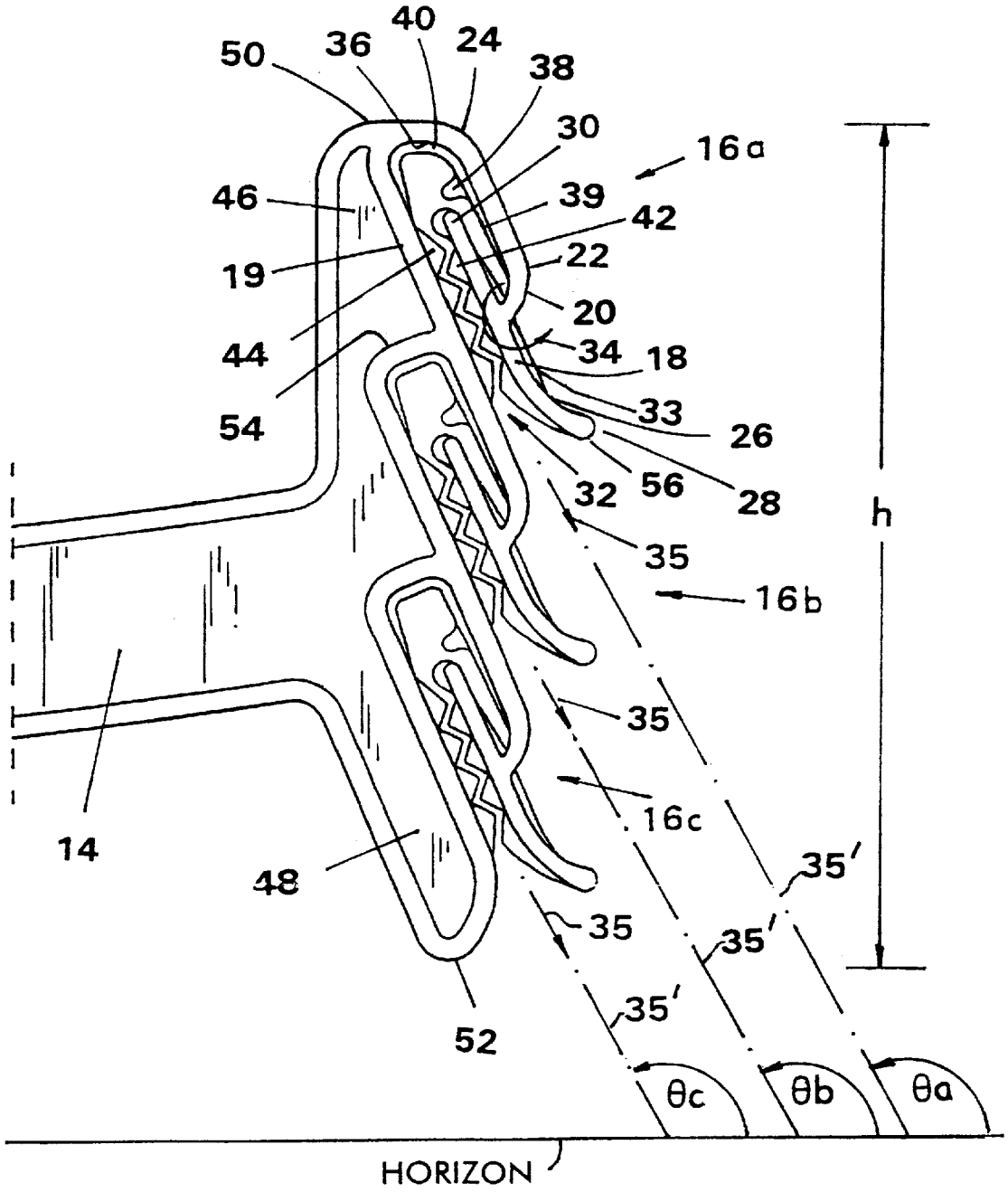

FIG. 1 is a front view of a hanger in accordance with a first embodiment of the invention; and FIG. 2 is a an enlarged view of one of the hanging clips shown in FIG. 1.

DETAILED DESCRIPTION OF THE PREFERRED EMBODIMENTS

Referring to FIG. 1, wherein like reference numerals indicate like elements, there is shown a multiple garment hanger 10 in accordance with the present invention. Garment hanger 10 can be made from any of the known materials by any of the known methods. Preferably, garment hanger 10 is made of a plastic material using injection molding techniques.

Garment hanger 10 includes a generally elongated bar 14 and a suspension hook 12 extending upwardly from elongated bar 14 in a first direction 13. Elongated bar 14 may be any shape, e.g., straight or curved, just as long as it is effective to allow hanger 10 to function as a hanger. At distal ends of elongated bar 14 are disposed a first garment clip arrangement 16 and a corresponding second garment clip arrangement 17, respectively. First and second garment clip arrangements 16, 17 are identical, mirror images of one another and so discussion will be made of first garment clip arrangement 16 only; it being clear that such discussion necessarily elucidates the structure and functioning of second garment clip arrangement 17 as well.

Referring now to FIG. 2, first garment clip arrangement 16 includes first, second, and third garment clips 16*a*, 16*b*, and 16*c* respectively. Although three garments clips are shown for illustrative purposes, a greater or fewer number of garment clips can be utilized. First garment clip 16*a* is coupled to elongated bar 14 through an upwardly extending arm 46 integrally joined to elongated bar 14. Second garment clip 16*b* is joined directly to elongated bar 14. Third garment clip 16*c* is joined with elongated bar 14 through a downwardly extending arm 48 that is also integral with elongated bar 14.

First, second, and third garment clips 16*a*, 16*b*, and 16*c* are identical and so reference will made to garment clip 16*a* only, it being understood that garment clips 16*b* and 16*c* have similar constructions. Garment clips 16*a*, 16*b*, and 16*c*, can comprise of any of the known garment clips. Preferably, garment clips 16*a*, 16*b* and 16*c* consist of the structure(s) described in U.S. Pat. No. 5,632,423, the entirety of which is hereby incorporated by reference. To help facilitate a full understanding of the structure, a brief description of the construction of the preferred garment clip is described below.

Garment clip 16*a* includes a garment pressing beam 18 which is preferably substantially supported by a carrier 20. Carrier 20 is coupled with elongated bar 14 through a connection member which includes a spring arm 22 and a curved connecting part 24.

Pressing beam 18 is operable to pivot about carrier 20 as is indicated by pivot arrow 34. It is preferred that pressing beam 18 have a width that is approximately the same as the width of elongated bar 14. It is most preferable that the width of pressing beam 18 be approximately 0.16 inches to 0.2 inches wide.

Pressing beam 18 includes on one end, an outwardly curved end 26 which terminates in a rounded head 28. Pressing beam 18 includes on another end, a curved head 30. Pressing beam 18 is disposed opposite to spring arm 22 of second garment clip 16*b*. Spring arm 22 of second garment clip 16*b* is further integral with a gap defining portion 19 of first garment clip 16*a*. Thus, garment pressing beam 18 of first garment clip 16*a*, spring arm 22 of second garment clip 16*b*, and gap defining portion 19 of first garment clip 16*a* define a gap 32 therein. As can be discerned, for the lowermost clip, in this case third garment clip 16*c*, spring arm 22 and downwardly extending arm 48 serve to define gap 32 for third garment clip 16*c*. Pressing beam 18 preferably further includes a longitudinal fillet or ridge 33 on a side of pressing beam 18 facing away from elongated bar 14. Fillet 33 serves to strengthen beam 18 and assists in providing beam 18 with sufficient stiffness.

Curved connecting part 24 also includes on its face 36, a narrow raised area 40 which has a width that is less than that of curved connecting part 24. Raised area 40 can be, for example, a fillet, ridge or web. Raised area 40 causes spring arm 22 to be pulled upwardly toward elongated bar 14 during a cooling process which occurs after hanger 10 is removed from an injection molding machine. Raised area 40 further reduces a gap which is formed between clamping surfaces on elongated bar 14 and pressing beam 18. The use of raised area 40 also enables the outer edges of curved connecting part 24 to cool off rapidly and so it can therefore support spring arm 22 prior to demoulding. However, the central, thicker portion of curved connecting part 24 remains hot upon demoulding and can act to pull spring arm 22 towards elongated bar 14. The reduced width of raised area 40 thus prevents hanger 10 from bending out of shape while also allowing pressing beam 18 to be moved closer to elongated bar 14 than is otherwise possible during molding.

On the inside face of curved connecting part 24, a raised area or stop element 38 is provided. Stop element 38 is preferably a round projection that extends normally from pressing beam 18. As more fully explained in U.S. Pat. No. 5,632,423, stop element 38 keeps an inserted garment in a proper position and prevents the garment from moving around curved head 30 and into a gap 39 between spring arm 22 and pressing beam 18.

Garment clip 16*a* further includes a serrated formation 42 disposed along the inside face of pressing beam 18 that mates with a complementary serrated formation 44 disposed along upwardly extending arm 46 of elongated bar 14. These serrated formations assist in gripping and retaining a garment placed therein.

Referring now again to FIG. 1, garment clips 16*a*, 16*b*, and 16*c* are disposed on elongated bar 14 in such a way as to minimize the height between the top 50 of first garment clip 16*a* and the bottom 52 of third garment clip 16*c* while still maintaining a vertical uniform outer display line for hung garments. A longitudinal axis "L" corresponding to a length "l" of each garment clip 16*a*, 16*b*, 16*c* is tilted with respect to elongated bar 14 and with respect to first direction 13. Garment clips 16*a*, 16*b* and 16*c* are thus each disposed obliquely with respect to elongated bar 14 and so gaps 32 extend in a second direction 35 which is oblique to first direction 13. Furthermore, second direction 35, if extrapolated to the horizon along lines 35', form angles θa, θb and θc, respectively which are about 90° to 180° with respect to the horizon.

By creating the aforementioned tilt, it is possible to place second garment clip 16*b* closer to first garment clip 16*a* and to place third garment clip 16*c* closer to second garment clip 16*b* than was possible in the prior art. Specifically, it is possible to overlap a portion of each garment clip with a portion of the garment clip above or below it. That is, first garment clip 16*a* overlaps at least a portion of second garment clip 16*b*, and second garment clip 16*b* overlaps at least a portion of third garment clip 16*c*. In this way, the distance between the top 50 of, for example, first garment clip 16*a* (disposed of at approximately the highest portion of curved connecting part 24) and the top 54 of second garment clip 16*b*, is less than the distance between the top 50 of first garment clip 16*a* and the bottom 56 of first garment clip 16*a* (disposed at approximately rounded head 28). Also, the length "l" of garment clip 16*a* (extending from curved connecting portion 24 to outwardly curved end 26 or optional rounded head 28) is greater than the distance between the top of first garment clip 16*a* and the top of second garment clip 16*b*.

This structuring allows an overall height "h" of the combined garment clips to be reduced as the distance from the top of a first clip to the top of a second clip immediately below the first clip is less than the length of a single clip. However, a uniform vertical outer display line is still maintained since the distance "d" (FIG. 1) between corresponding garments clips in first and second garment clip arrangements 16, 17, is the same. That is, the distance between first garment clip 16*a* and a first garment clip 17*a* is the same as the distance between, for example, third garment clip 16*c* and a third garment clip 17*c*.

Thus, by tilting garment clips in respective garment clip arrangements on a hanger so that one garment clip overlaps a garment clip immediately beneath it, the problems inherent in prior art hangers are avoided. A plurality of garments can be hung on the hanger without necessitating increased vertical space and while still maintaining a uniform vertical outer display line.

Having described the preferred embodiments it should be made clear that various changes can be made to the described embodiments without departing from the scope and spirit of the invention which is defined more clearly in the appended claims.

What is claimed is:

1. A hanger comprising:

an elongated bar; and at least one garment clip arrangement disposed on said elongated bar, said garment clip arrangement having at least a first garment clip including a first gripping member which receives and retains a first garment therein and a second garment clip including a second gripping member which receives and retains a second garment therein, said gripping members each including an opening that faces away from said elongated bar and receives said garments, wherein:

said first gripping member is disposed immediately above said second gripping member and overlaps at least a portion of said second gripping member.

2. The hanger as claimed in claim 1, further comprising a third garment clip disposed on said garment clip arrangement, wherein said first garment clip is connected to said elongated bar through an upwardly extending arm and said third garment clip is connected to said elongated bar through a downwardly extending arm.

3. The hanger as claimed in claim 1, further comprising a second garment clip arrangement and wherein said garment clip arrangements are disposed at distal ends of said elongated bar.

4. The hanger as claimed in claim 1, further comprising a hook extending from said elongated bar in a first direction, and wherein said garment clips are disposed obliquely with respect to said first direction.

5. The hanger as claimed in claim 1, wherein said garment clips are disposed on said elongated bar so that said garment clips produce a uniform vertical outer display line for garments displayed on said hanger.

6. A hanger comprising:

an elongated bar; and at least one garment clip arrangement disposed on said elongated bar, said at least one garment clip arrangement having at least a first garment clip including a first gripping member which receives and retains a first garment therein and a second garment clip including a second gripping member which receives and retains a second garment therein, each gripping member including an opening that faces away from said elongated bar and receives said garments and each gripping member having a top and a bottom; wherein said garment clips are arranged so that the distance between a top of said first gripping member and a top of said second gripping member disposed immediately below said first gripping member, is less than the distance between said top of said first gripping member and said bottom of said first gripping member.

7. The hanger as claimed in claim 6, further comprising a third garment clip disposed on said garment clip arrangement, wherein said first garment clip is connected to said elongated bar through an upwardly extending arm and said third garment clip is connected to said elongated bar through a downwardly extending arm.

8. The hanger as claimed in claim 6, further comprising a second garment clip arrangement and wherein said garment clip arrangements are disposed at distal ends of said elongated bar.

9. The hanger as claimed in claim 6, wherein said garment clips are disposed on said elongated bar so that said garment clips produce a uniform vertical outer display line for garments displayed on said hanger.

10. The hanger as claimed in claim 6, wherein said first clip is disposed over said second clip and said first clip further overlaps at least a portion of said second clip.

11. The hanger as claimed in claim 6, further comprising a hook extending from said elongated bar in a first direction, wherein said garment clips are disposed obliquely with respect to said first direction.

12. A hanger comprising:

an elongated bar;

a hook extending from said elongated bar in a first direction; and at least a first and a second garment clip arrangement disposed on said elongated bar, each garment clip arrangement having at least a first garment clip including a first gripping member which receives and retains a first garment therein and a second garment clip including a second gripping member which receives and retains a second garment therein, said gripping members including an opening that faces away from said elongated bar and which receives said garments, wherein:

each garment clip is disposed obliquely with respect to said first direction.

13. The hanger as claimed in claim 12, wherein each garment clip comprises a first and a second retaining member, said first and second retaining member defining a gap therebetween.

14. The hanger as claimed in claim 12, wherein said first retaining member is a pressing beam, said second retaining member is a spring arm, and wherein said pressing beam and said spring arm define said gap therebetween.

15. The hanger as claimed in claim 12, further comprising a second and a third garment clip disposed on said garment clip arrangement, wherein said first garment clip is connected to said elongated bar through an upwardly extending arm and said third garment clip is connected to said elongated bar through a downwardly extending arm.

16. The hanger as claimed in claim 12, wherein said pressing beam and said downwardly extending arm define a gap of said third garment clip.

17. The hanger as claimed in claim 12, wherein said garment clip arrangements are disposed at distal ends of said elongated bar.

18. The hanger as claimed in claim 12, wherein said garment clips are disposed on said elongated bar so that said garment clips produce a uniform vertical outer display line for garments displayed on said hanger.

19. A hanger comprising:

an elongated bar extending in a generally horizontal direction; and at least one garment clip arrangement disposed on said elongated bar, said garment clip arrangement having at least a first garment clip including a first gripping member which receives and retains a first garment therein and a second garment clip including a second gripping member which receives and retains a second garment therein, said gripping members each including an opening that faces away from said elongated bar and receives said garments, wherein:

said gripping members are disposed at an angle with respect to said elongated bar that is not equal to ninety degrees.

20. The hanger as claimed in claim 19, wherein said first garment clip is disposed above said second garment clip and overlaps at least a portion of said second garment clip.

21. The hanger as claimed in claim 19, wherein said garment clips are disposed at an angle of about 90 to 180 degrees with respect to said elongated bar.

22. The hanger as claimed in claim 21, wherein said garment clips are disposed at an angle of about 45 degrees.

23. A hanger for hanging at least one garment above a floor, said hanger comprising:

an elongated bar; and at least one garment clip arrangement disposed on said elongated bar, said garment clip arrangement having at least a first garment clip including a first gripping member which receives and retains a first garment therein and a second garment clip including a second gripping member which receives and retains a second garment therein, said gripping members each including an opening that faces away from said elongated bar and receives said garments, wherein:

said gripping members are disposed at an angle with respect to a plane defined by said floor that is not equal to ninety degrees.

24. The hanger as claimed in claim 23, wherein said first clip is disposed above said second garment clip and overlaps as least a portion of said second garment clip.

25. The hanger as claimed in claim 23, wherein said garment clips are disposed at an angle of about 90 to 180 degrees with respect to said plane.

26. The hanger as claimed in claim 25, wherein said garment clips are disposed at an angle of about 45 degrees.

* * * * *